US008911100B2

(12) United States Patent
Tsai

(10) Patent No.: US 8,911,100 B2
(45) Date of Patent: Dec. 16, 2014

(54) SELF-GENERATING LIGHTING SHOWER HEAD

(71) Applicant: Agreat Shower & Sanitary (Xiamen) Co., Ltd, Xiamen (CN)

(72) Inventor: Pi-Kuang Tsai, Taichung (TW)

(73) Assignee: Agreat Shower & Sanitary (Xiamen) Co., Ltd., Xiamen, Fujian Province (CN)

( * ) Notice: Subject to any disclaimer, the term of this patent is extended or adjusted under 35 U.S.C. 154(b) by 98 days.

(21) Appl. No.: 13/837,332

(22) Filed: Mar. 15, 2013

(65) Prior Publication Data

US 2014/0268650 A1 Sep. 18, 2014

(51) Int. Cl.
*F21V 33/00* (2006.01)

(52) U.S. Cl.
CPC ..... *F21V 33/004* (2013.01)
USPC ..... 362/96

(58) Field of Classification Search
CPC ..... A47K 3/28; F21V 33/00; F21V 23/06; B05B 1/14; B05B 15/06; B05B 1/18; B05B 15/00; F21Y 101/02; F21S 9/04; F03B 1/00
USPC ..... 362/96
See application file for complete search history.

(56) References Cited

U.S. PATENT DOCUMENTS

| | | | | |
|---|---|---|---|---|
| 7,178,746 | B2 * | 2/2007 | Gross | 239/552 |
| 7,841,732 | B2 * | 11/2010 | Coushaine et al. | 362/96 |
| 2009/0236444 | A1 * | 9/2009 | Kunkel et al. | 239/289 |
| 2011/0210188 | A1 * | 9/2011 | Yao et al. | 239/71 |
| 2011/0216526 | A1 * | 9/2011 | Li | 362/96 |

FOREIGN PATENT DOCUMENTS

| | | | | |
|---|---|---|---|---|
| EP | 1958700 | A2 * | 8/2008 | F21V 33/00 |

* cited by examiner

*Primary Examiner* — Donald Raleigh
(74) *Attorney, Agent, or Firm* — Muncy, Geissler, Olds & Lowe, P.C.

(57) ABSTRACT

The present invention of a self-generating lighting shower head comprises a top hood, an upper holder, an inlet header, a revolving part, a lower holder, an electric module, a shade unit, and a shower head disc unit: the upper holder is held in the top hood; the inlet header is installed in the water bearing space; the revolving part with a number of rotary vanes is placed in the inlet header and rotates under rush of water flows via water inlets; the lower holder has a watertight cavity at bottom to accommodate the electric module; the electric module comprises a spindle pivoted to and driven by the revolving part for generation of electric energy transformed from dynamic energy and luminescence excited by a number of luminous components on a printed circuit board. As such, the present invention is capable of generating electricity supplied to luminous components for illumination during a shower.

3 Claims, 10 Drawing Sheets

SELF-GENERATING LIGHTING SHOWER HEAD

BACKGROUND OF THE INVENTION

1. Field of the Invention

The present invention relates to a bathroom appliance, particularly a self-generating lighting shower head which depends on water flows to generate electricity power.

2. Description of the Prior Art

Shower heads used by people have evolved dramatically diversified models for bathes because people who indulge in cleaning bodies with hands need to fast rinse all body parts by wall-mounted shower heads which radially spray water at a large area and satisfy the general public's versatile demands such as adjustable discharge or intensity of water and massage effect based on strong water flows. Having studied a conventional shower head's structure, the inventor argued some drawbacks in the prior art need to be corrected, for instance, unknown cleanliness of the body of a shower head user who stays in a dark bathroom during electric outrage or illumination insufficient, or more power consumed due to other electric lights installed.

SUMMARY OF THE INVENTION

The present invention is intended for providing a detachable self-generating lighting shower head which depends on water flows to generate electric power used in luminescence and promotes functionality and maintenance.

To realize the above purposes, the present invention of self-generating lighting shower head comprises:

A top hood with a through hole;

An upper holder held inside said top hood and comprising a joint part at top and a water bearing space at bottom: said joint part which protrudes from said through hole on said top hood and links an outlet hose of a bathroom comprises a clearance hole leading to said water bearing space to which water flows from said outlet hose is conveyed;

An inlet header held in said upper holder's water bearing space and comprising (a) a water feeding space centrally and downward and (b) a number of water inlets arranged circumferentially and leading to said water feeding space, both of which allow water originally held in said upper holder's water bearing space to pass through and run downward;

A revolving part comprising a core hole centrally and a number of radial rotary vanes circumferentially which are held in said water feeding space of said inlet header and rotate under rush of water flows;

A lower holder, a component slightly smaller than said water bearing space of said upper holder, comprising (a) an assembly-related core hole at top which is located under said water bearing space of said upper holder for development of an appropriate gap, (b) a watertight cavity under said core hole, and (c) a number of discharge orifices on circumference of said watertight cavity through which downward water flows out of said inlet header's water feeding space pass through said gap between said lower holder and said upper holder and run outward;

An electric module provided with a spindle, a protective shell, a printed circuit board and a number of luminous components on said printed circuit board and held in said watertight cavity of said lower holder: said spindle protruding from said watertight cavity is pivoted to said core hole of said revolving part and synchronously driven by said revolving part for output of electric energy transformed from dynamic energy because of rush of external water flows;

A shade unit comprising a shade, a first washer, and a bolt-on disc, all of which are assembled with female threads on said bolt-on disc screwed onto male threads at a lower end of said lower holder;

A shower head disc unit installed at said upper holder's bottom and comprising a center hole aligning said lower holder's watertight cavity, separating luminous components from water, and surrounded by a plurality of nozzles through which water flows passing through said gap between said lower holder and said upper holder are sprayed downward.

BRIEF DESCRIPTION OF THE DRAWINGS

The drawings disclose an illustrative embodiment of the present invention of a which serves to exemplify the various advantages and objects hereof, and are as follows.

DETAILED DESCRIPTION OF THE PREFERRED EMBODIMENT

Figure 1:
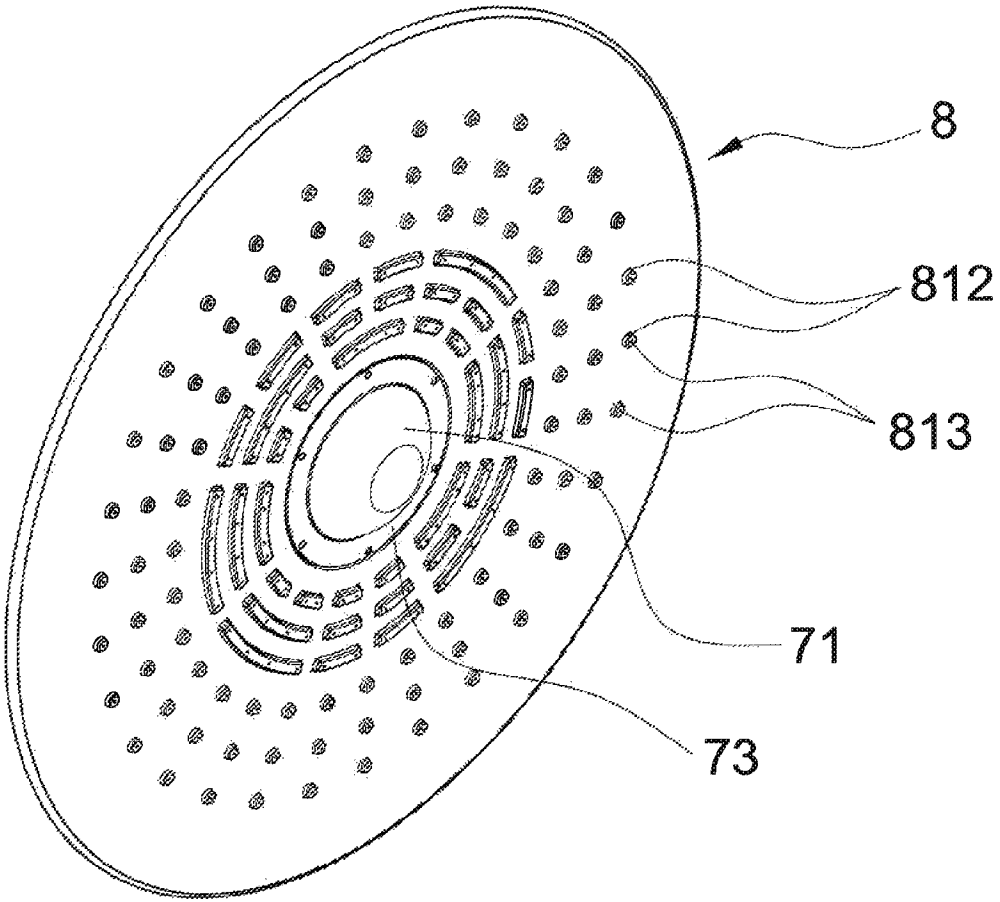
FIG. 1 is a perspective view for exterior of the present invention.
Figure 2:
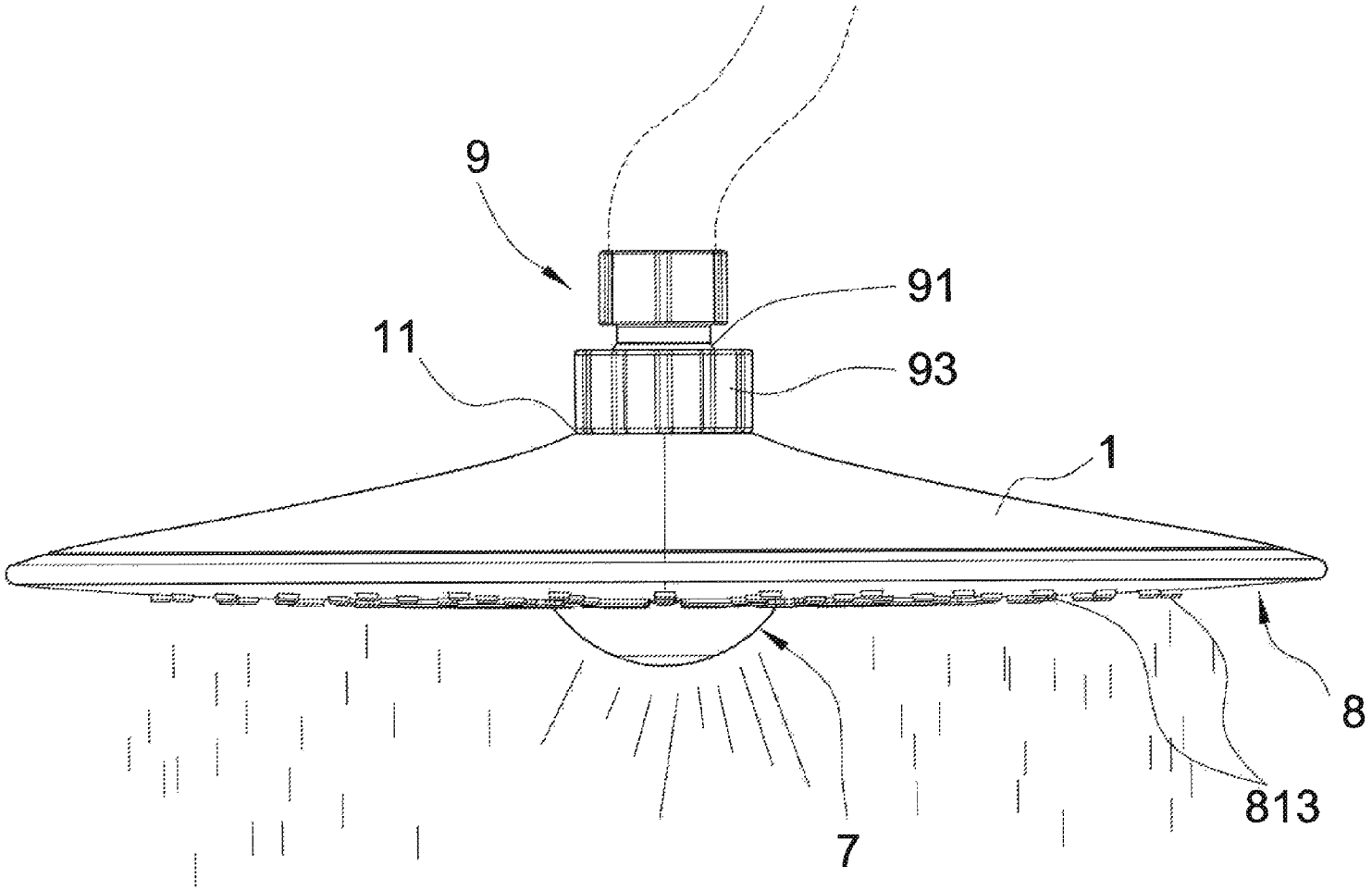
FIG. 2 is a side view for exterior of the present invention.
Figure 3:
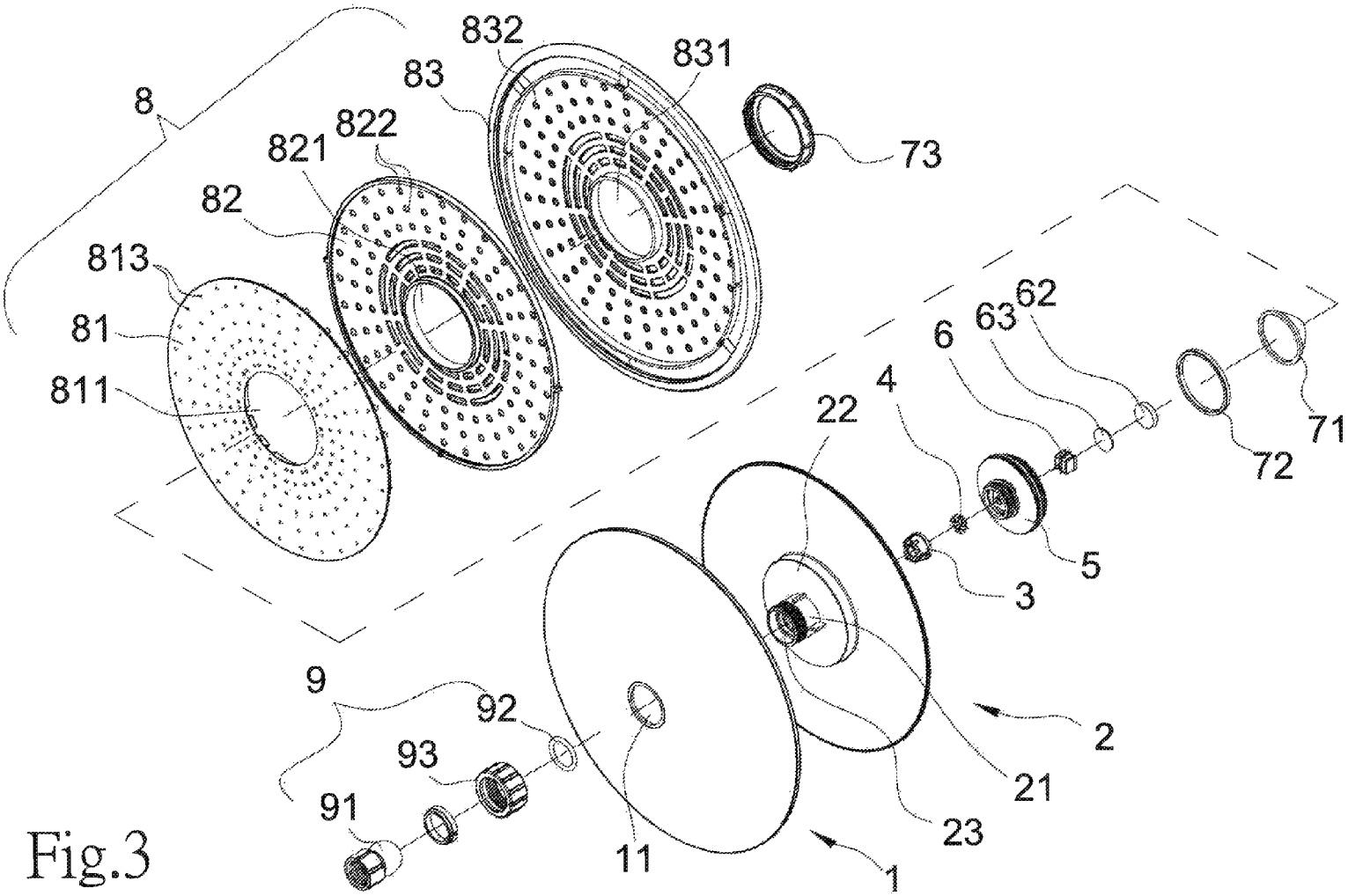
FIG. 3 is an exploded perspective view of the present invention observed from the top.
Figure 4:
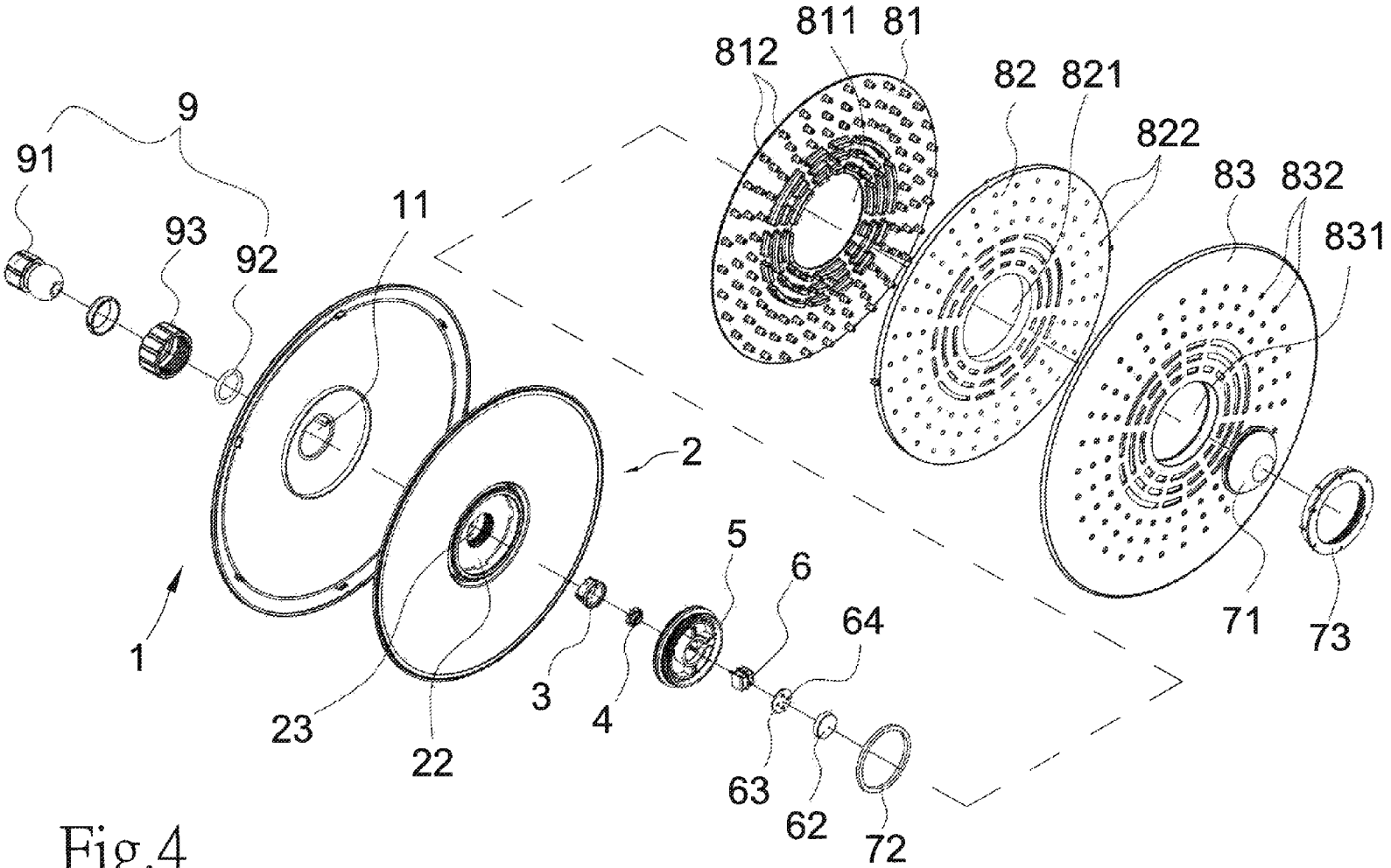
FIG. 4 is an exploded perspective view of the present invention observed from the bottom.

Referring to FIG. 1 through FIG. 4 which illustrate the present invention of a self-generating lighting shower head comprising a top hood 1, an upper holder 2, an inlet header 3, a revolving part 4, a lower holder 5, an electric module 6, a shade unit 7, and a shower head disc unit 8.

The top hood 1 is designed as a hollow dish-shaped hood with diameters tapering from bottom to top and a through hole 11 at its center top.

The upper holder 2 is a dish-shaped body held inside the top hood 1 and comprising (a) a raised joint part 21 located at top and exposed from the through hole 11 of the top hood 1 and (b) a water bearing space 22 at the bottom: the joint part 21 comprises a stepped clearance hole 23, which leads to the water bearing space 22 and has a length of female threads at its lower end, and a length of male threads situated at its top exterior. The clearance hole 23 of the joint part 21 is passed through by an adapter 9 for completion of an assembly based on a procedure as follows: (a) a spheroid part 91 of the adapter 9 is held in a second washer 92; (b) a nut 93 is screwed onto the male threads of the joint part 21; (c) the adapter 9 is coupled with an outlet hose (not shown in figures) of a bathroom for conveying external water into the water bearing space 22 of the upper holder 2 via the outlet hose.

Figure 5:
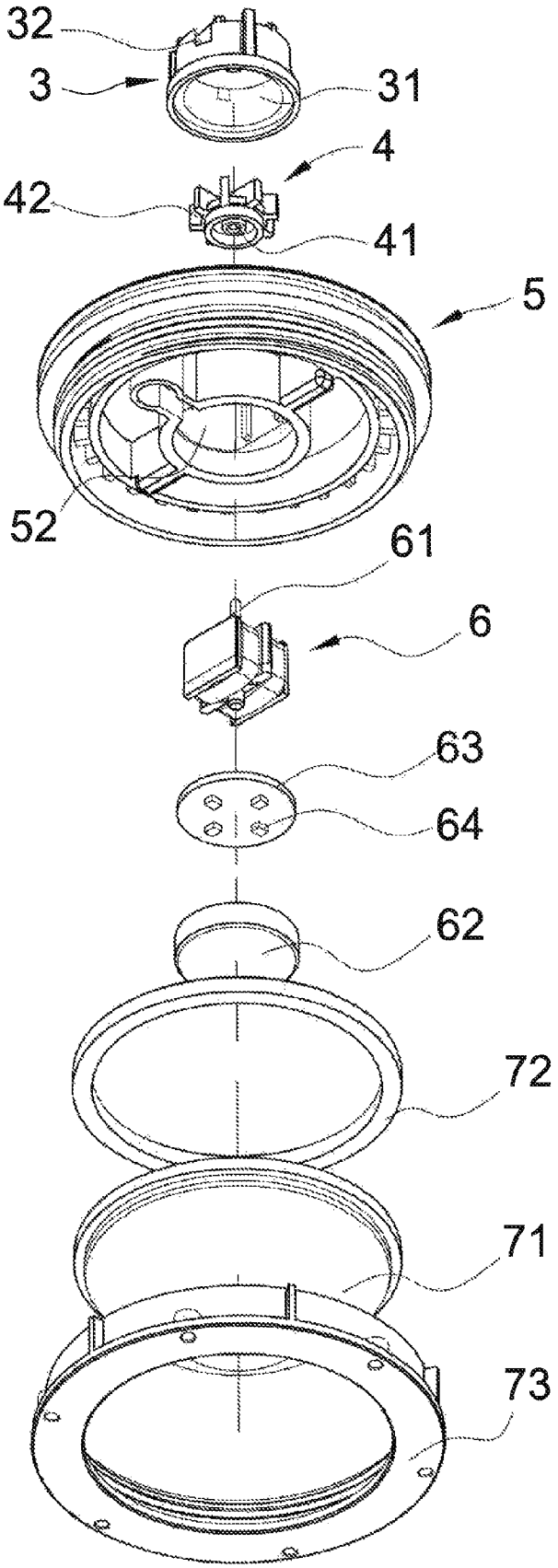
FIGS. 5 and 6 are enlargement views illustrating components such as inlet header, revolving part, electric module and shade unit
Figure 6:
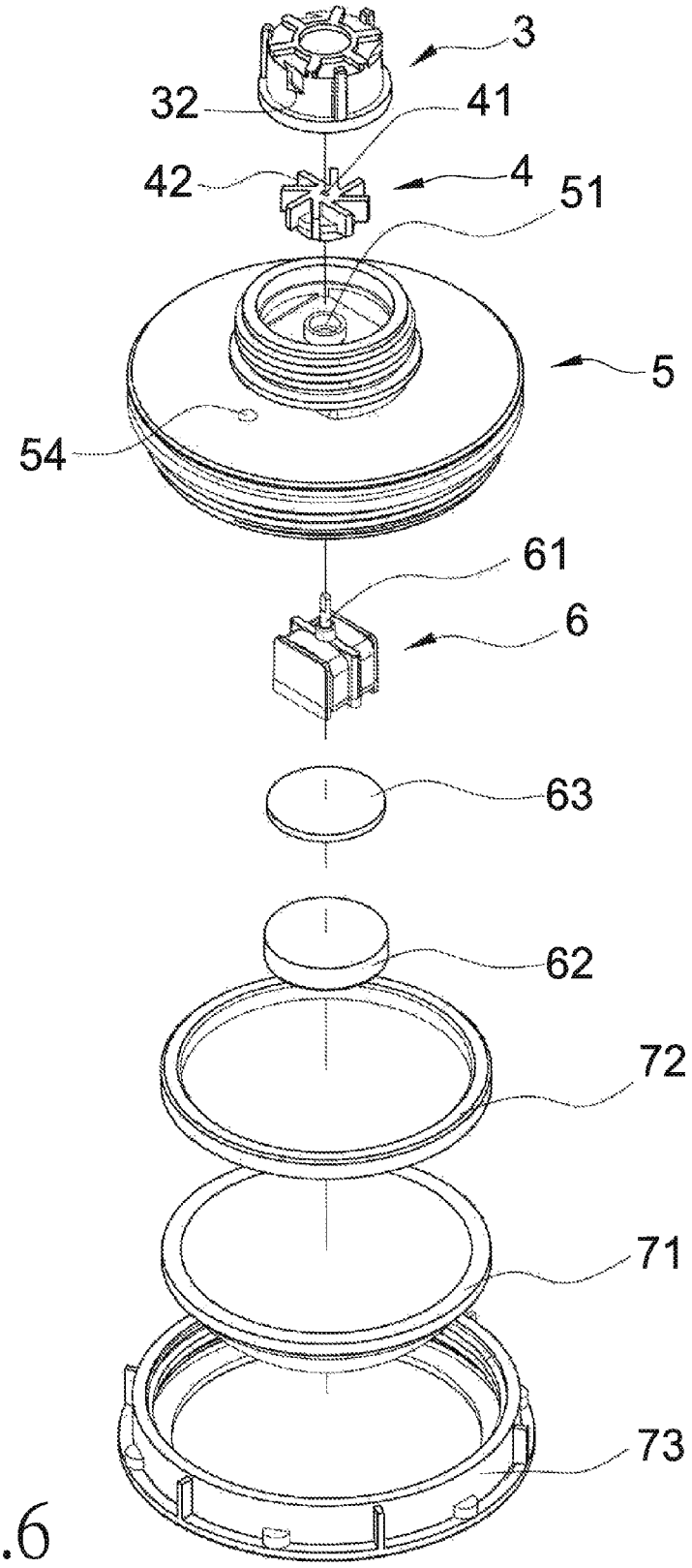
Figure 7:
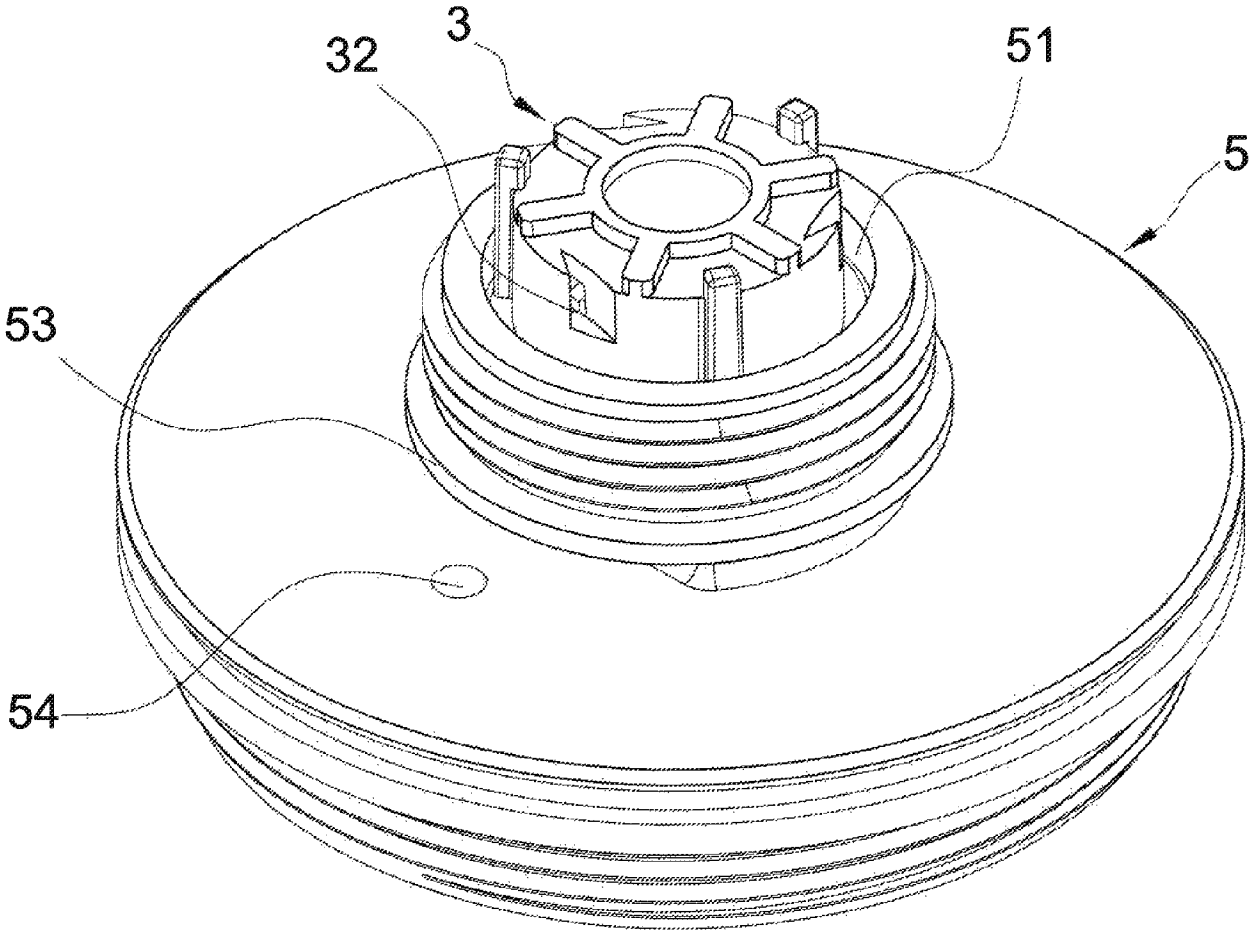
FIG. 7 is a schematic perspective view illustrating an inlet header, a revolving part, an electric module and a shade unit, all of which are assembled.

Referring to FIGS. 5 and 6 that illustrate the inlet header 3 to be held in the clearance hole 23 on the upper holder 2 (FIG. 7) has a water feeding space 31 centrally and downward and a number of water inlets 32 circumferentially by which the water feeding space 31 is accessed.

The revolving part 4 comprises a core hole 41 centrally for assembly and a number of radial rotary vanes 42 circumferentially.

The lower holder 5, a component slightly smaller than the water bearing space 22 of the upper holder 2, comprises (a) an assembly-related core hole 51 at top, (b) male threads circumferentially which are screwed onto the female threads at the lower end of the clearance hole 23 on the upper holder 2, (c) an appropriate gap (FIG. 10) created in the water bearing space 22 and taken as a channel of water flows in the case of the lower holder 5 under the water bearing space 22 of the upper holder 2, (d) a watertight cavity 52 under the assembly-related core hole 51, and (e) a number of discharge orifices 53 and male threads on circumference of the watertight cavity 52.

Figure 8:
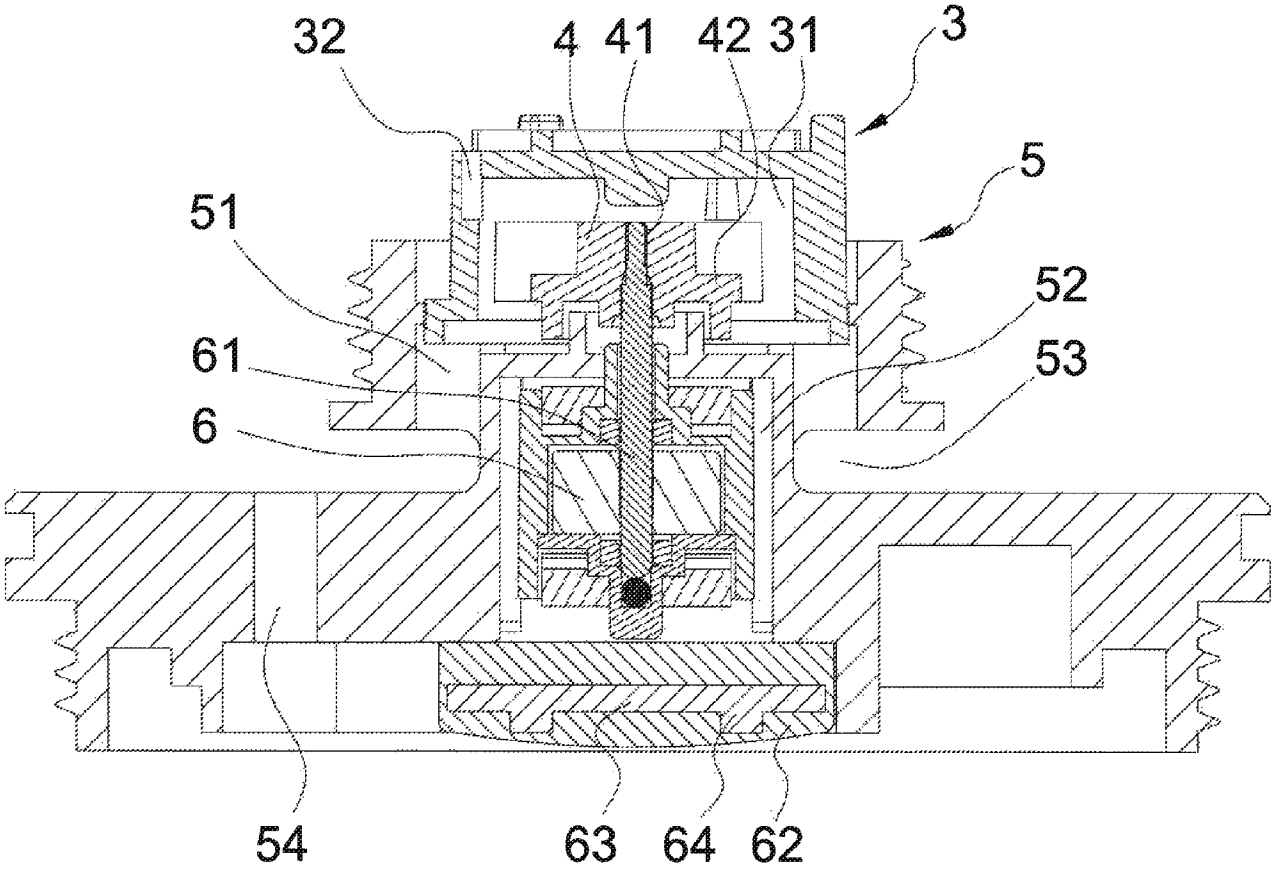
FIG. 8 is a sectional view which illustrates the inlet header, the revolving part, the electric module and the shade unit in FIG. 7, all of which are assembled.
Figure 9:
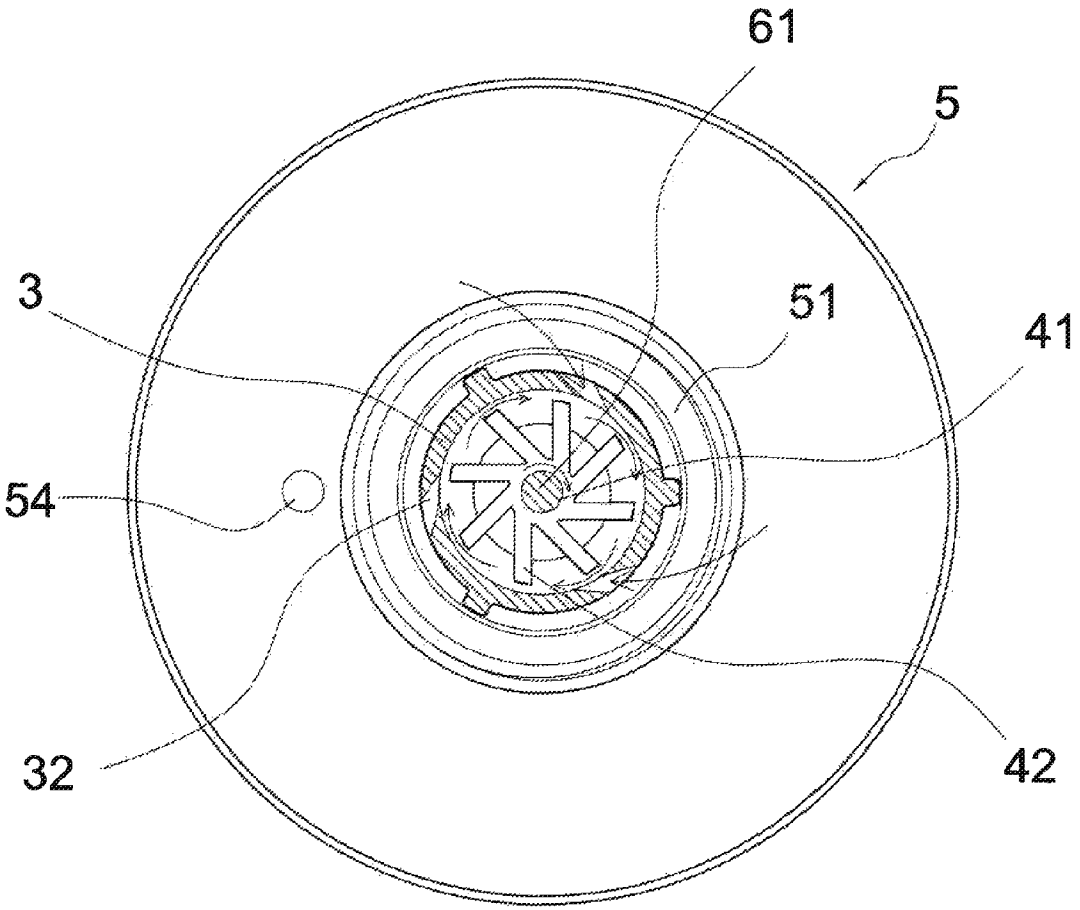
FIG. 9 is a schematic view which illustrates rotating vanes of a revolving part hit by water flows in an inlet header.

The electric module 6 held in the watertight cavity 52 of the lower holder 5 is provided with a spindle 61, a protective shell 62, a printed circuit board 63 and a number of luminous components 64 on the printed circuit board 63: the spindle 61 protruding from the watertight cavity 52 is pivoted to the core hole 41 of the revolving part 4 (FIG. 8) and synchronously driven by rotary vanes of the revolving part 4 (FIG. 9) for output of electric energy transformed from dynamic energy because of rush of external water flows which are conveyed into the water bearing space 22 and the water feeding space 31 via the assembly-related core hole 51 on the lower holder 5 and the water inlets 32 around the inlet header 3, respectively; the luminous components 64 with electricity supplied are able to excite luminescence as a light source and preferably consist of Light Emitting Diodes (LED) in this embodiment; the protective shell 62 is watertight; the inlet header 3, the revolving part 4, the lower holder 5, and the electric module 6 are designed as one module which is detachable and in favor of reassembly and maintenance.

For better lighting and watertight effect, the present invention is further provided with a shade unit 7 comprising a shade 71, a first washer 72, and a bolt-on disc 73, all of which are assembled with female threads on the bolt-on disc 73 screwed onto male threads at a lower end of the lower holder 5.

The shower head disc unit 8 (FIGS. 3 and 4) consists of a disc-shaped upper cap 81, a middle cap 82 and a lower cap 83, all of which are installed at the bottom of the upper holder 2 and assembled onto the top hood 1: the upper cap 81 (the middle cap 82, the lower cap 83) has a center hole 811 (821, 831) which aligns the shade 71 and the bolt-on disc 73 of the shade unit 7 under the watertight cavity 52 of the lower holder 5 for watertight effect; the upper cap 81 comprises a plurality of axial stubs 812, each of which is deployed around the center hole 811 and has a nozzle 813 centrally; the middle cap 82 (lower cap 83) comprises round orifices 822 (832) deployed around the center hole 821 (831) and aligning the axial stubs 812 on the upper cap 81 in order to make water flows sprayed via the nozzles 813.

Figure 10:
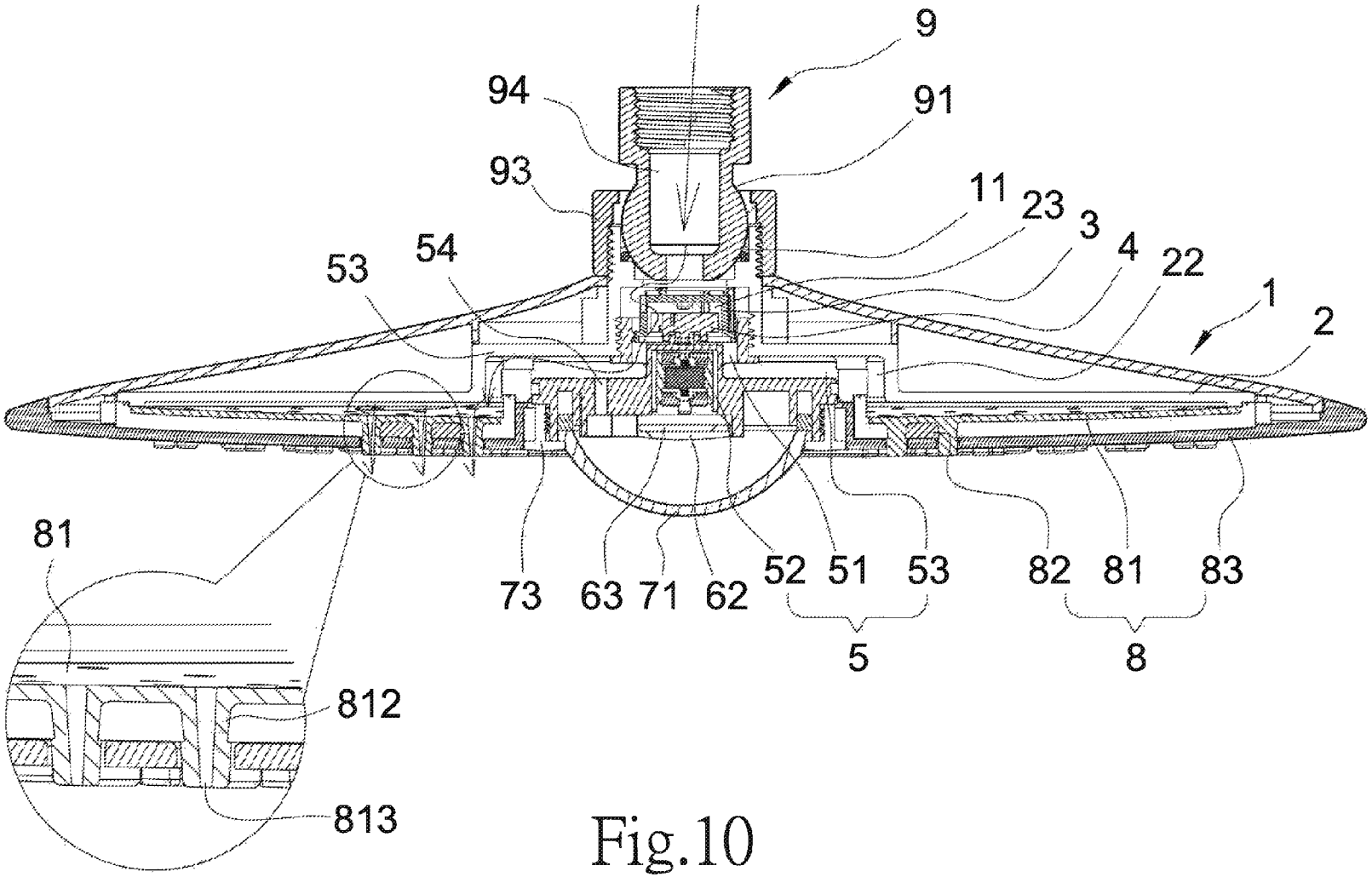
FIG. 10 is a sectional view illustrating the present invention assembled and routes of water flows.

Referring to FIG. 10 which illustrates the present invention of a self-generating lighting shower head assembled with the above components in service: the present invention of a self-generating lighting shower head links an outlet hose (not shown in FIG. 10) of a bathroom with the adapter 9 and freely rotated by the spheroid part 91 for spraying water according to a user's demand; external water flows are conveyed into the lower holder 5 via the adapter 9, the water bearing space 22 via the clearance hole 23, and the water feeding space 31 via the water inlets 32 of the inlet header 3, rush onto the revolving part 4 for rotations (FIG. 9), and synchronously turn the spindle 61 in the electric module 6 for generation and supply of electric energy transformed from dynamic energy and luminescence excited by the luminous components 64. Next, the water flows are directed toward the discharge orifices 53 of the lower holder 5, a gap between the lower holder 5 and the upper holder 2, and the shower head disc unit 8 sequentially and sprayed downward from the nozzles 813 on the shower head disc unit 8. The present invention of a self-generating lighting shower head is capable of supplying clean descending shower water to the revolving part 4 by which dynamic energy can be transformed to electric energy as power to make the electric module 6 radiate. Moreover, the electric module 6 which is centrally installed at an inner ring of the shower head with the nozzles 813 circumferentially arranged is effective in projecting brilliant clear light with some advantages such as light not affected by sprayed water flows, any body part clearly observed by a shower head user, no consumption of extra electric power, and expected purposes including improved functionality, environment-friendly effect and energy efficiency. In addition, versatile illumination and even diversified colors are available in the present invention of a self-generating lighting shower head because of design of the printed circuit board 63 and LED luminous components 64 on the electric module 6 in favor of changeable backgrounds and industrial competitiveness.

In the second embodiment of the present invention, the electric module 6 further comprises a thermometer (not shown in figures) with its sensor head deployed at a thermometer hole 54 on the lower holder 5 by which temperature of water flows passing through the discharge orifices 53 is detected, particularly temperature higher (lower) than a default value is highlighted with red (blue) light emitted from the luminous components 64; the custom-oriented colors and corresponding temperatures can be setup in the printed circuit board 63; the disable thermometer hole 54 can be sealed with a plug (not shown in figures).

Many changes and modifications in the above described embodiment of the invention of a can, of course, be carried out without departing from the scope thereof. Accordingly, to promote the progress in science and the useful arts, the invention is disclosed and is intended to be limited only by the scope of the appended claims.

What is claimed is:

1. A self-generating lighting shower head, comprising:

A top hood with a through hole;

An upper holder held inside said top hood and comprising a joint part at top and a water bearing space at bottom: said joint part which protrudes from said through hole on said top hood and links an outlet hose of a bathroom comprises a clearance hole leading to said water bearing space to which water flows from said outlet hose is conveyed;

An inlet header held in said upper holder's water bearing space and comprising (a) a water feeding space centrally and downward and (b) a number of water inlets arranged circumferentially and leading to said water feeding space, both of which allow ater originally held in said upper holder's water bearing space to pass through and run downward;

A revolving part comprising a core hole centrally and a number of radial rotary vanes circumferentially which are held in said water feeding space of said inlet header and rotate under rush of water flows;

A lower holder, a component slightly smaller than said water bearing space of said upper holder, comprising (a) an assembly-related core hole at top which is located under said water bearing space of said upper holder for development of an appropriate gap, (b) a watertight cavity under said core hole, and a number of discharge orifices on circumference of said watertight cavity through which downward water flows out of said inlet header's water feeding space pass through said gap between said lower holder and said upper holder and run outward;

An electric module provided with a spindle, a protective shell, a printed circuit board and a number of luminous components on said printed circuit board and held in said watertight cavity of said lower holder: said spindle protruding from said watertight cavity is pivoted to said core hole of said revolving part and synchronously driven by said revolving part for output of electric energy transformed from dynamic energy because of rush of external water flows;

A shade unit comprising a shade, a first washer, and a bolt-on disc, all of which are assembled with female threads on said bolt-on disc screwed onto male threads at a lower end of said lower holder;

A shower head disc unit installed at said upper holder's bottom and comprising a center hole aligning said lower holder's watertight cavity, separating luminous components from water, and surrounded by a plurality of nozzles through which water flows passing through said gap between said lower holder and said upper holder are sprayed downward.

2. The self-generating lighting shower head according to claim 1 wherein said shower head disc unit consists of a disc-shaped upper cap, a middle cap, and a lower cap, each of which has a center hole: said upper cap comprises a plurality of axial stubs raised downward, each of which is deployed around its center hole and has a nozzle centrally; said middle cap (lower cap) comprises round orifices deployed around its center hole and penetrated by said upper cap's axial stubs to be exposed outside.

3. The self-generating lighting shower head according to claim 1 wherein said upper holder comprises a length of male threads at its joint part: said joint part allows its clearance hole to be passed through by an adapter for completion of an assembly based on a procedure as follows, (a) a spheroid part of said adapter is held in a second washer, (b) a nut is screwed onto said male threads of said joint part, and (c) said adapter's core hole is coupled with an outlet hose of a bathroom for conveying external water into said the present invention of a shower head.

* * * * *